US011435107B2

(12) United States Patent
Ino et al.

(10) Patent No.: US 11,435,107 B2
(45) Date of Patent: Sep. 6, 2022

(54) AIR CONDITIONING SYSTEM

(71) Applicant: Mitsubishi Electric Corporation, Tokyo (JP)

(72) Inventors: Hiroyuki Ino, Tokyo (JP); Hidetoshi Muramatsu, Tokyo (JP); Yoshiaki Koizumi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 15 days.

(21) Appl. No.: 16/496,680

(22) PCT Filed: Oct. 27, 2017

(86) PCT No.: PCT/JP2017/038965
§ 371 (c)(1),
(2) Date: Sep. 23, 2019

(87) PCT Pub. No.: WO2018/230008
PCT Pub. Date: Dec. 20, 2018

(65) Prior Publication Data

US 2020/0033021 A1 Jan. 30, 2020

(30) Foreign Application Priority Data

Jun. 14, 2017 (WO) ..... PCT/JP2017/021995

(51) Int. Cl.
*F24F 11/65* (2018.01)
*F24F 11/523* (2018.01)
(Continued)

(52) U.S. Cl.
CPC ..... *F24F 11/65* (2018.01); *F24F 1/68* (2013.01); *F24F 11/523* (2018.01); *F24F 11/56* (2018.01)

(58) Field of Classification Search
CPC .. F24F 11/62; F24F 11/63; F24F 11/64; F24F 11/65; F24F 11/523; F24F 11/56; F24F 11/54
See application file for complete search history.

(56) References Cited

U.S. PATENT DOCUMENTS

2009/0062964 A1* 3/2009 Sullivan ..... G05B 15/02 700/276
2012/0253521 A1* 10/2012 Storm ..... G05B 15/02 236/51
(Continued)

FOREIGN PATENT DOCUMENTS

EP 2 782 359 A1 9/2014
EP 2 829 813 A1 1/2015
(Continued)

OTHER PUBLICATIONS

International Search Report of the International Searching Authority dated Aug. 8, 2017 in corresponding International application No. PCT/JP2017/021995 (and English translation).
(Continued)

*Primary Examiner* — Mohammad Ali
*Assistant Examiner* — Vincent W Chang
(74) *Attorney, Agent, or Firm* — Posz Law Group, PLC

(57) ABSTRACT

An air conditioning system according to the present invention includes: a first air conditioner; a second air conditioner; a first operation terminal capable of operating the first air conditioner; a second operation terminal capable of operating the second air conditioner; and a portable terminal that receives, from the first operation terminal, first setting information including first information for operating the first air conditioner or the second air conditioner, and second information that is information on the first operation terminal or the second operation terminal, generates transmission
(Continued)

information on the basis of the first setting information, and transmits the transmission information to the second operation terminal.

11 Claims, 11 Drawing Sheets

(51) Int. Cl.
*F24F 11/56* (2018.01)
*F24F 1/68* (2011.01)

(56) References Cited

U.S. PATENT DOCUMENTS

| | | | | |
|---|---|---|---|---|
| 2013/0123991 | A1* | 5/2013 | Richmond | G05D 23/1902 700/276 |
| 2014/0324231 | A1* | 10/2014 | Kawai | G08C 17/02 700/276 |
| 2015/0061879 | A1* | 3/2015 | Sone | G05B 15/02 340/635 |
| 2015/0219354 | A1 | 8/2015 | Isono et al. | |
| 2015/0308705 | A1* | 10/2015 | Sloo | G05B 15/02 700/276 |
| 2016/0146492 | A1* | 5/2016 | Tomomatsu | F24F 11/62 700/276 |
| 2016/0182704 | A1 | 6/2016 | Minezawa et al. | |
| 2017/0234567 | A1* | 8/2017 | Frader-Thompson | F24F 11/0001 700/276 |
| 2018/0074471 | A1* | 3/2018 | Poplawski | F24F 11/62 |
| 2019/0101306 | A1* | 4/2019 | Giorgi | F24F 13/10 |
| 2020/0033019 | A1* | 1/2020 | Kitade | F24F 11/49 |
| 2020/0088435 | A1* | 3/2020 | Inoue | F24F 11/57 |

FOREIGN PATENT DOCUMENTS

| | | | |
|---|---|---|---|
| EP | 2 950 011 | A2 | 12/2015 |
| JP | 2012-078001 | A | 4/2012 |
| JP | 2013-076493 | A | 4/2013 |
| JP | 2013-245835 | A | 12/2013 |
| JP | 2014-031957 | A | 2/2014 |
| JP | 2014-217071 | A | 11/2014 |
| JP | 2015-105763 | A | 6/2015 |
| JP | 2015-143590 | A | 8/2015 |
| JP | 2015-224858 | A | 12/2015 |
| JP | 2016-178470 | A | 10/2016 |

OTHER PUBLICATIONS

International Search Report of the International Searching Authority dated Jan. 9, 2018 in corresponding International application No. PCT/JP2017/038965 (and English translation).
Office Action dated Jun. 30, 2020 issued in corresponding AU patent application No. 2017418380.
Office Action dated Jun. 9, 2020 issued in corresponding JP patent application No. 2019-525045 (and English translation).
Office Action dated Oct. 10, 2020 issued in corresponding CN patent application No. 201780091036.7 (and English translation).
Extended European Search Report dated May 19, 2020 issued in corresponding EP patent application No. 17914037.1.
Japanese Notice of Opposition dated Apr. 22, 2021, issued in corresponding Japanese Patent Application No. 2019-525045.
Office Action dated Jan. 7, 2021 issued in corresponding Australian patent application No. 2017418380.
Chinese Office Action dated Apr. 28, 2021, issued in corresponding Chinese Patent Application No. 201780091036.7 (and English Machine Translation).
Office Action dated Aug. 4, 2021, issued in corresponding CN Patent Application No. 201780091036.7 (and English Machine Translation).

* cited by examiner

| |
|---|
| ON-OFF TIMER |
| WEEKLY SCHEDULE |
| OPERATION RESTRICTIONS ON SET TEMPERATURE |
| ENERGY SAVING SETTING |
| REMOTE CONTROLLER SCREEN DISPLAY SETTING |
| ... |

FIG.8

SELECT TERMINAL TO BE CONNECTED...

| Name | Signal |
| --- | --- |
| REMOTE CONTROLLER 10-1 | 60 |
| REMOTE CONTROLLER 10-2 | 20 |

AIR CONDITIONING SYSTEM

CROSS REFERENCE TO RELATED APPLICATION

This application is a U.S. national stage application of International Patent Application No. PCT/JP2017/038965 filed on Oct. 27, 2017, which claims priority to International Patent Application No. PCT/JP2017/021995 filed on Jun. 14, 2017, the disclosure of which is incorporated herein by reference.

TECHNICAL FIELD

The present invention relates to an air conditioning system including an operation terminal, and to a portable terminal.

BACKGROUND

In recent years, air conditioners have become multifunctional and highly functional. Functions owned by an air conditioner include, for example, a weekly schedule function that can change a set temperature for each day of the week, an energy saving function that detects temperatures of a person and the person's surrounding using a sensor and accordingly minimizes waste of blowing to reduce power consumption, and a user restriction function that restricts an operation range of the air conditioner for each user.

In order to use these functions, it is necessary to make detailed settings on the air conditioner. In addition, many of remote controllers that are operation terminals of air conditioners are of a button-type configured to be operated by pressing a button, and as compared with touch panel type configured to be operated by directly touching its screen with a finger, not easy to input information such as numerical values. Therefore, it takes a lot of time to perform settings.

As an example of a technique for facilitating these settings, a technique described in Patent Literature 1 can be exemplified. In the technique described in Patent Literature 1, an application dedicated to an air conditioner is installed on a portable terminal such as a smartphone instead of a remote controller, and thereby the smartphone is used in place of the remote controller. The smartphone is of a touch panel type, and with the use of the smartphone, a user can easily input information for settings and can shorten time taken for the settings as compared with a case of using a button-type remote controller.

PATENT LITERATURE

Patent Literature 1: Japanese Patent Application Laid-open No. 2013-76493

However, when changing settings of two or more air conditioners, it is necessary to individually set their remote controllers corresponding to the air conditioners. For that reason, even if the settings are performed using a smartphone, the settings have to be performed for the number of air conditioners, and the user requires much time to make setting for the remote controllers.

SUMMARY

The present invention has been made in view of the above circumstances, and an object thereof is to provide an air conditioning system capable of minimizing time required for setting remote controllers of a plurality of air conditioners.

In order to solve the above-mentioned problems and achieve the object, the present invention provides an air conditioning system comprising: a first air conditioner; a second air conditioner; a first operation terminal capable of operating the first air conditioner; a second operation terminal capable of operating the second air conditioner; and a portable terminal to receive, from the first operation terminal, first setting information formed from first information for operating the first air conditioner or the second air conditioner and second information that is information on the first operation terminal or the second operation terminal, to generate transmission information on the basis of the first setting information, and to transmit the transmission information to the second operation terminal.

The air conditioning system according to the present invention achieves an advantageous effect that time required for setting remote controllers of a plurality of air conditioners can be minimized.

BRIEF DESCRIPTION OF DRAWINGS

FIG. 8 is a view illustrating an example of a start screen of a first setting information changing application according to the first embodiment.

DETAILED DESCRIPTION

Hereinbelow, an air conditioning system and a portable terminal will be described in detail with reference to the drawings. The present invention is not limited by these embodiments.

First Embodiment

Figure 1:
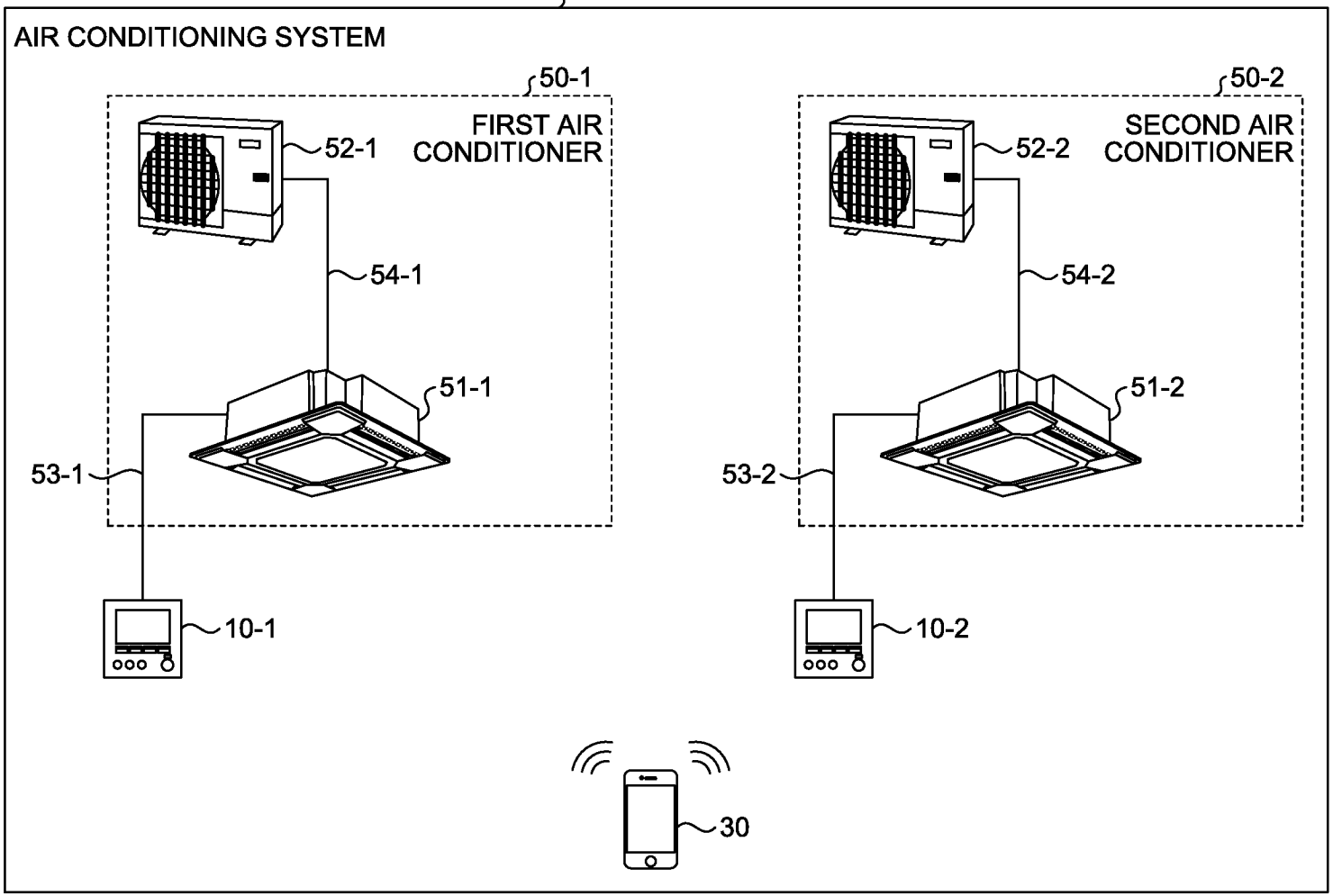
FIG. 1 is a system configuration diagram of air conditioners according to a first embodiment.

FIG. 1 is a system configuration diagram of air conditioners according to a first embodiment. An air conditioning system 60 includes: a remote controller 10-1 and a remote controller 10-2; an indoor unit 51-1 and an indoor unit 51-2;

an outdoor unit 52-1 and an outdoor unit 52-2; a remote controller indoor unit communication line 53-1 and a remote controller indoor unit communication line 53-2; an indoor unit outdoor unit communication line 54-1 and an indoor unit outdoor unit communication line 54-2; and a portable terminal 30.

When the remote controller 10-1 and the remote controller 10-2 are mentioned without distinction, they are referred to as a remote controller 10 case by case. When the indoor unit 51-1 and the indoor unit 51-2 are mentioned without distinction, they are referred to as an indoor unit 51 case by case. When the outdoor unit 52-1 and the outdoor unit 52-2 are mentioned without distinction, they are referred to as an outdoor unit 52 case by case. When the remote controller indoor unit communication line 53-1 and the remote controller indoor unit communication line 53-2 are mentioned without distinction, they are referred to as a remote controller indoor unit communication line 53 case by case. When the indoor unit outdoor unit communication line 54-1 and the indoor unit outdoor unit communication line 54-2 are mentioned without distinction, they are referred to as an indoor unit outdoor unit communication line 54 case by case.

The indoor unit 51-1, the outdoor unit 52-1, the remote controller indoor unit communication line 53-1, and the indoor unit outdoor unit communication line 54-1 are collectively referred to as a first air conditioner 50-1. In addition, the indoor unit 51-2, the outdoor unit 52-2, the remote controller indoor unit communication line 53-2, and the indoor unit outdoor unit communication line 54-2 are collectively referred to as a second air conditioner 50-2. When the first air conditioner 50-1 and the second air conditioner 50-2 are mentioned without distinction, they are referred to as an air conditioner 50 case by case. The first air conditioner 50-1 and the second air conditioner 50-2 do not have to be installed in the same space. For example, the first air conditioner 50-1 may be installed on the first floor of a building, and the second air conditioner 50-2 may be installed on the second floor of the building.

The first air conditioner 50-1 is operated by the remote controller 10-1 that is a first operation terminal, and the second air conditioner 50-2 is operated by the remote controller 10-2 that is a second operation terminal.

Figure 3:
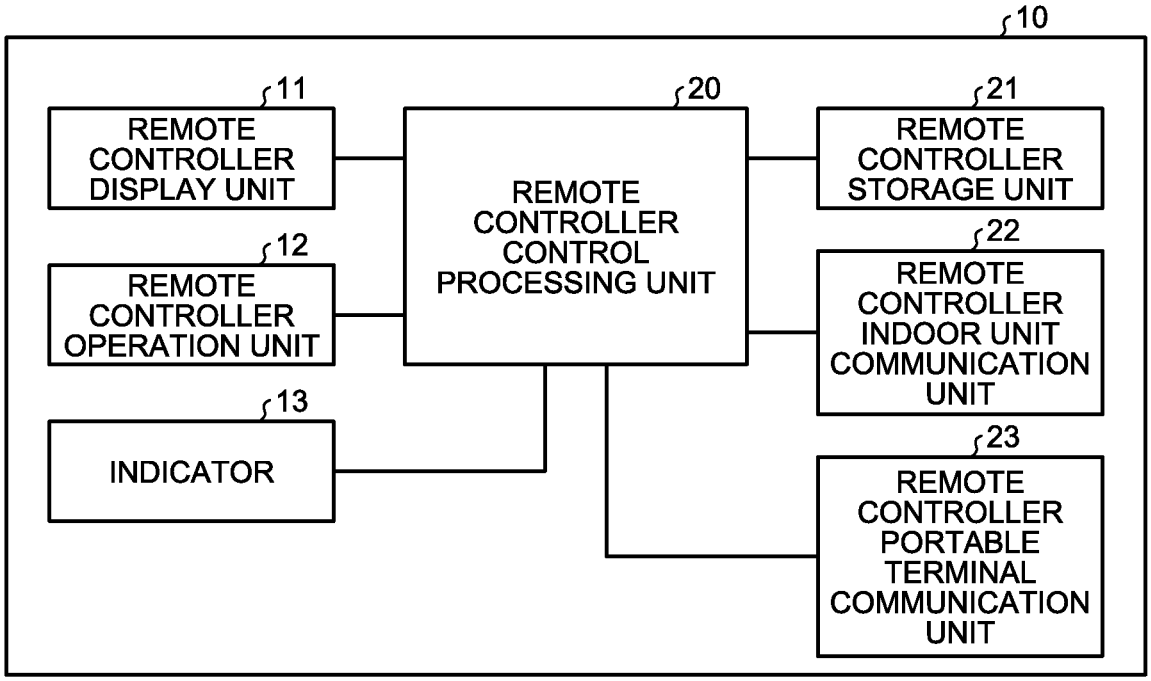
FIG. 3 is a diagram illustrating functional blocks of the remote controller according to the first embodiment.
Figure 5:
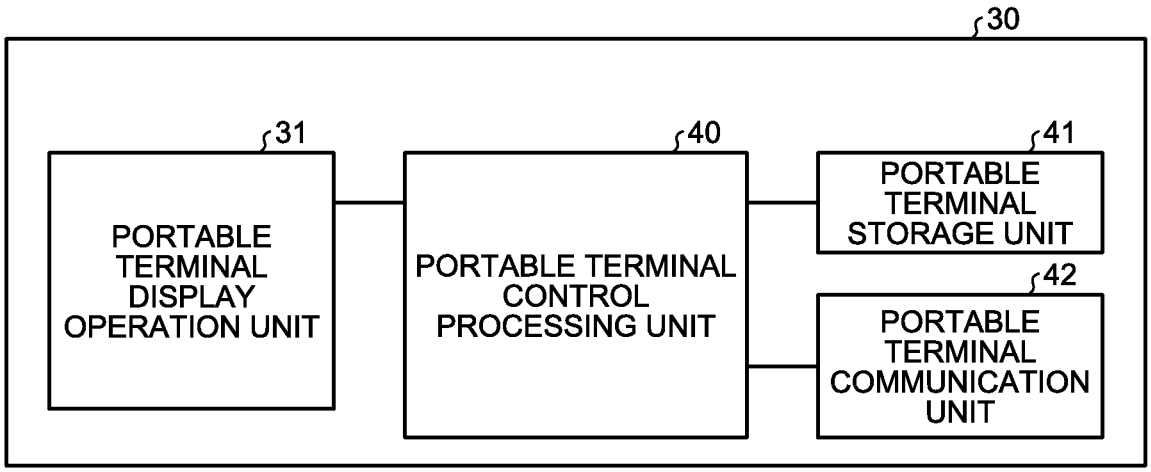
FIG. 5 is a diagram illustrating functional blocks of the portable terminal according to the first embodiment.

The remote controller 10 and the portable terminal 30 can transmit and receive information by communication between a remote controller portable terminal communication unit 23 illustrated in FIG. 3 and a portable terminal communication unit 42 illustrated in FIG. 5, described later. As an example of the information transmitted from the remote controller 10 to the portable terminal 30, there is operating state information indicating a cooling or heating operation mode of the indoor unit 51. As examples of the information transmitted from the portable terminal 30 to the remote controller 10, there are first setting information (described later) retained by the remote controller 10, and operation information on the indoor unit 51 for operations such as changing a set temperature of the indoor unit 51, and turning on and off the indoor unit 51. The information transmitted and received between the remote controller 10 and the portable terminal 30 is not limited in the embodiments of the present invention.

In the present embodiment, the remote controller 10 and the portable terminal 30 transmit and receive information by radio communication, but the communication between the remote controller 10 and the portable terminal 30 is not limited to radio communication.

The remote controller indoor unit communication line 53 is a communication line used for communication between the remote controller 10 and the indoor unit 51. The information transmitted and received by the remote controller 10 and the indoor unit 51 is operating state information on the indoor unit 51, operation information on the indoor unit 51, and the like. The indoor unit outdoor unit communication line 54 is a communication line used for communication for the indoor unit 51 and the outdoor unit 52 to transmit and receive information for performing air conditioning control and the like.

Figure 2:
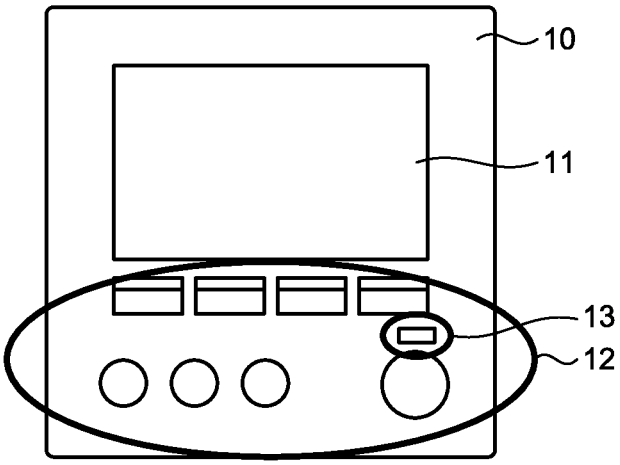
FIG. 2 is a view illustrating an example of the appearance of a remote controller according to the first embodiment.

FIG. 2 is a view illustrating an example of the appearance of the remote controller according to the first embodiment. FIG. 3 is a diagram illustrating functional blocks of the remote controller according to the first embodiment. The remote controller 10 includes a remote controller display unit 11, a remote controller operation unit 12, an indicator 13, a remote controller control processing unit 20, a remote controller storage unit 21, a remote controller indoor unit communication unit 22, and the remote controller portable terminal communication unit 23.

The remote controller display unit 11 displays an operating state, setting information, and the like, of the air conditioner 50. A user operates the remote controller operation unit 12 to input information for operation or the first setting information of the air conditioner 50. The remote controller operation unit 12 receives, from the user, an input of information for operation or the first setting information of the air conditioner 50. The first setting information is constituted by first information and second information. The first information is information for operating the air conditioner 50. For example, the first information is operation start time, operation end time, and the like, which are to be set when an operation using an on-off timer used for operation of the air conditioner 50 is performed. The second information is information related to the remote controller 10, which includes information to be displayed on the remote controller display unit 11 of the remote controller 10, and information for operating the remote controller 10. For example, the second information to be displayed on the remote controller display unit 11 is information on a current time, contrast display, and the like. For example, the second information for operating the remote controller 10 corresponds to setting information of a user restriction function for the remote controller 10 and the like. As the current time, the time is set in either 24-hour notation or in am/pm notation. Regarding the first information and the second information, information on model names of the indoor unit 51 and the outdoor unit 52 connected to the portable terminal 30, or manufacturer's serial numbers of the indoor unit 51 and the outdoor unit 52 may be included in the first information and the second information. The indicator 13 blinks when a confirmation request signal described later is received from the portable terminal 30. The remote controller indoor unit communication unit 22 communicates with the indoor unit 51. The remote controller portable terminal communication unit 23 communicates with the portable terminal 30. The remote controller control processing unit 20 performs control so that information sent from the remote controller indoor unit communication unit 22 and the remote controller portable terminal communication unit 23 are retained in the remote controller storage unit 21. The remote controller storage unit 21 retains the first setting information.

When the user changes the first setting information, the remote controller display unit 11 displays a setting screen having a plurality of layers. As the setting screen having a plurality of layers, a screen constituted by a selection screen which is a screen of a first layer and a change screen which is a screen of a second layer is exemplified. The selection screen is a setting screen that is initially displayed on the remote controller display unit 11 when the first setting information is set. The selection screen is, for example, a screen on which items such as an on-off timer and a current time are displayed. The change screen is a screen that is subjected to transition depending on an item selected on the selection screen. The change screen is, for example, a screen for setting an operation start time and an operation end time of the on-off timer when the on-off timer is selected on the selection screen. Although the example has been described here in which the screen has two layers, there is no limitation thereto, and the screen may be configured to have three or more layers.

Figure 4:
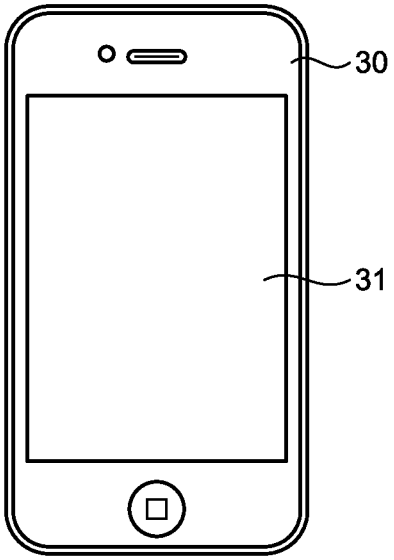
FIG. 4 is a view illustrating an example of the appearance of a portable terminal according to the first embodiment.

FIG. 4 is a view illustrating an example of the appearance of the portable terminal according to the first embodiment. FIG. 5 is a diagram illustrating functional blocks of the portable terminal according to the first embodiment. The portable terminal 30 includes a portable terminal display operation unit 31, a portable terminal control processing unit 40, a portable terminal storage unit 41, and a portable terminal communication unit 42.

The portable terminal display operation unit 31 displays the first setting information and the like, and receives an input of information for changing the content of settings from the user. The portable terminal control processing unit 40 controls the portable terminal storage unit 41 to retain information inputted from the portable terminal communication unit 42. The portable terminal storage unit 41 retains first setting information of the air conditioner 50. In addition, the portable terminal storage unit 41 can retain a plurality of pieces of the first setting information acquired from the remote controller 10 and a plurality of pieces of second setting information to be described later. The plurality of pieces of information retained by the portable terminal storage unit 41 is, for example, the first setting information of the first air conditioner 50-1 and the second air conditioner 50-2. Alternatively, the plurality of pieces of information retained by the portable terminal storage unit 41 is the plurality of pieces of the second setting information of the first air conditioner 50-1 changed by the user depending on the intended use. The first information and the second information may include information on the model names of the indoor units 51 and the outdoor units 52 connected to the portable terminal 30, or the manufacturer's serial numbers of the indoor units 51 and the outdoor units 52. By virtue of the fact that the first information and the second information include the information on the model names of the indoor units 51 and the outdoor units 52 connected to the portable terminal 30, or the manufacturer's serial numbers of the indoor units 51 and the outdoor units 52, the portable terminal 30 can identify the plurality of pieces of the retained information and the air conditioners 50 in the case where the portable terminal 30 retains the plurality of pieces of the first setting information or the second setting information. The portable terminal communication unit 42 communicates with the remote controller portable terminal communication unit 23.

The remote controller control processing unit 20 is realized by a processing circuit that is an electronic circuit that performs each process. The processing circuit may be a dedicated hardware set, or a control circuit that has a memory and a central processing unit (CPU) that executes a program stored in the memory. Here, for instance, the memory corresponds to a nonvolatile or volatile semiconductor memory such as a random access memory (RAM), a read only memory (ROM), or a flash memory, a magnetic disk, an optical disk, or the like. The control circuit serves as, for example, a control circuit 400 having a configuration illustrated in FIG. 6.

Figures 6, 7:
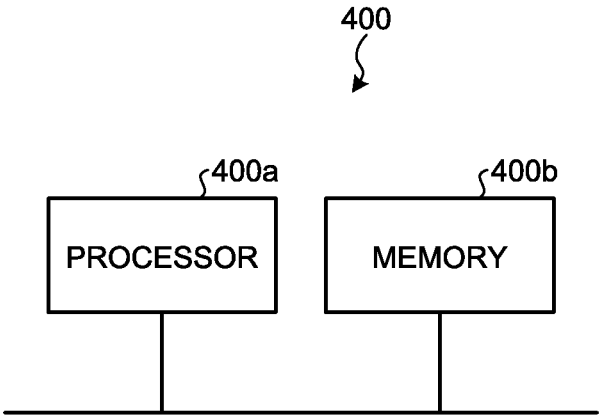
FIG. 6 is a diagram illustrating an example configuration of a control circuit of the first embodiment.
FIG. 7 is a diagram illustrating an example of items for first setting information according to the first embodiment.

As illustrated in FIG. 6, the control circuit 400 includes a processor 400*a* which is a CPU and a memory 400*b*. In the case where the remote controller control processing unit 20 is realized by the control circuit 400 illustrated in FIG. 6, such a realization is made by the processor 400*a* reading and executing a program corresponding to each process, which is stored in the memory 400*b*. The memory 400*b* is also used as a temporary memory in each process performed by the processor 400*a*.

The remote controller storage unit 21 is realized by a memory. The remote controller display unit 11 is realized by, for example, a display, or a monitor. The remote controller operation unit 12 is realized by, for example, a button. The indicator 13 is, for example, a light emitting diode (LED). The remote controller indoor unit communication unit 22 and the remote controller portable terminal communication unit 23 are each realized by a communication circuit.

Similarly to the remote controller control processing unit 20, the portable terminal control processing unit 40 is realized by a processing circuit that is an electronic circuit that performs each process. The processing circuit serves as the control circuit 400 having a configuration illustrated in FIG. 6, similarly to the remote controller control processing unit 20. A description of the control circuit 400 will be omitted.

The portable terminal storage unit 41 is realized by a memory. The portable terminal display operation unit 31 is realized by, for example, a touch panel. The portable terminal communication unit 42 is realized by a communication circuit.

FIG. 7 is a diagram illustrating an example of items of the first setting information according to the first embodiment. The user can change the items of the first setting information illustrated in FIG. 7. The user operates the portable terminal display operation unit 31 of the portable terminal 30 on which an application for changing first setting information (hereinafter referred to as a first setting information changing application) has been installed, and changes the items of the first setting information written in FIG. 7. The items of the first setting information are not limited in any embodiments of the present invention.

What is meant by the fact that the first setting information changing application is installed on the portable terminal 30 is that a program for the first setting information changing application is stored in the memory 400*b* of the portable terminal 30 to be startable. The first setting information changing application is executed by the processor 400*a* of the portable terminal 30.

FIG. 8 is a view illustrating an example of a start screen of the first setting information changing application according to the first embodiment. The user starts the application by pressing an icon of the first setting information changing application displayed on the portable terminal display operation unit 31 to display the start screen of FIG. 8. The user can select the remote controller 10 to which the portable terminal 30 is to be connected by operating this screen.

Figure 9:
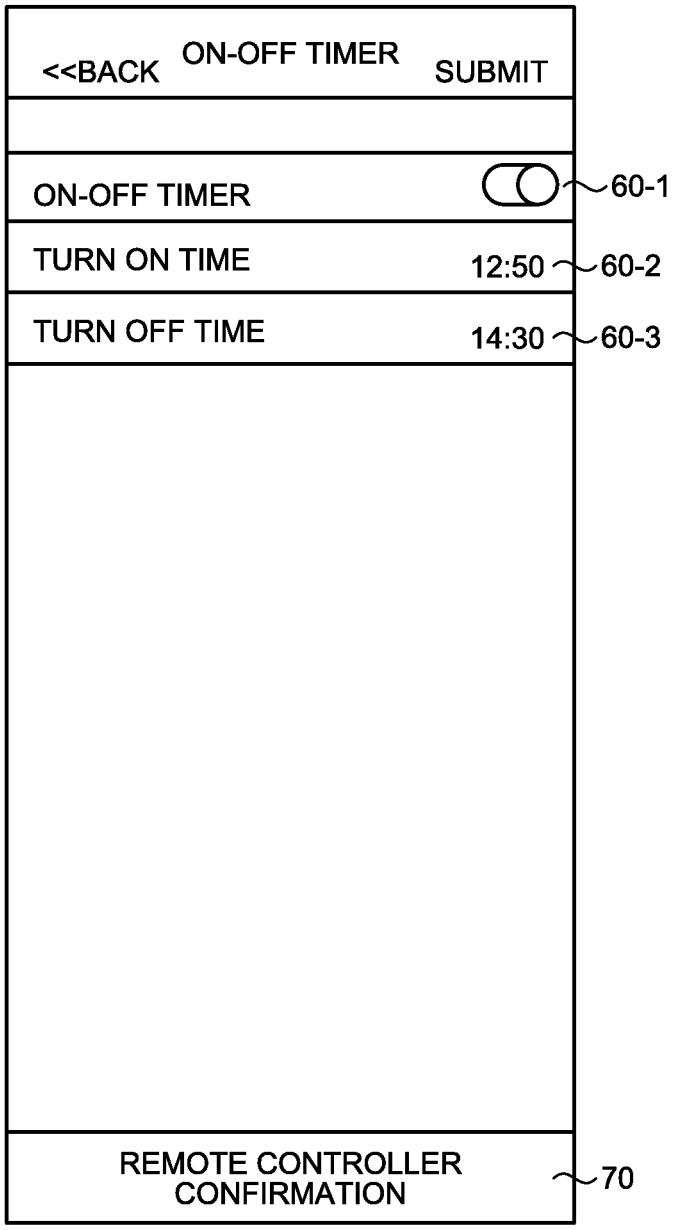
FIG. 9 is a view illustrating an example of a setting screen of the first setting information displayed on the portable terminal according to the first embodiment.

FIG. 9 is a view illustrating an example of a setting screen of the first setting information displayed on the portable terminal according to the first embodiment. A setting field 60-1 is an area for receiving an input of switching between on and off of the first setting information. The user can perform switching between on and off by operating the setting field 60-1. A setting field 60-2 and a setting field 60-3 are areas for receiving inputs of numerical values corresponding to items of a turn-on time and a turn-off time, respectively. The user can input or change the numerical values corresponding to the items of the turn-on time and the turn-off time by operating the setting field 60-2 and the setting field 60-3. A remote controller confirmation button 70 is a button used to specify the remote controller 10 to which the portable terminal 30 is connected, which can be pressed after the portable terminal 30 is connected to the remote controller 10. Although FIG. 9 illustrates a display screen when the on-off timer is set, the remote controller confirmation button 70 is displayed also when other items of the first setting information than the on-off timer are changed. In the present embodiment, as illustrated in FIG. 9, the remote controller confirmation button 70 is displayed in a lower part of the setting screen of the first setting information, but it is satisfactory as long as the remote controller confirmation button 70 can be pressed after the portable terminal 30 is connected to the remote controller 10, and a display manner thereof is not limited.

Figure 10:
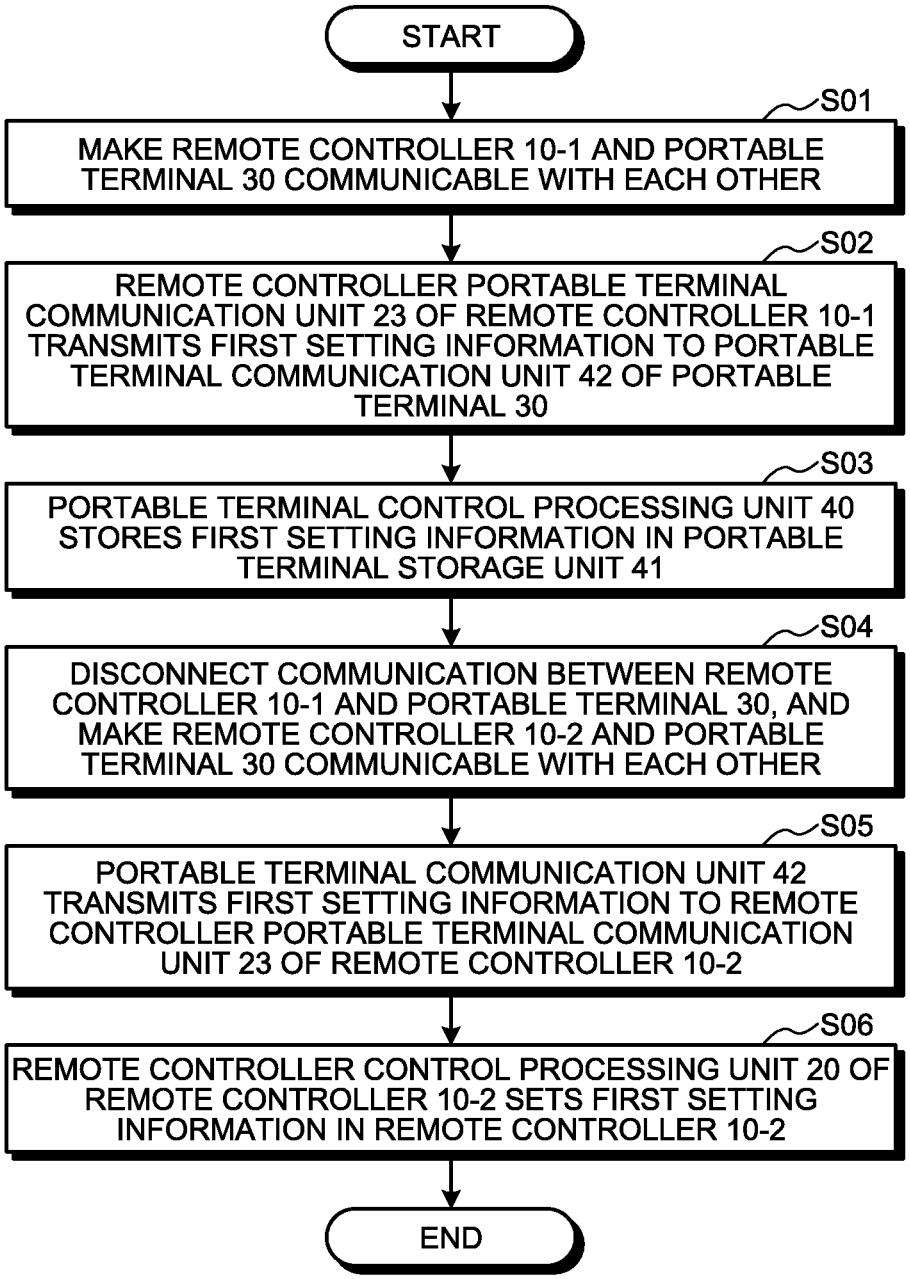
FIG. 10 is a flowchart illustrating a setting method for air conditioning control according to the first embodiment.

FIG. 10 is a flowchart illustrating a setting method for air conditioning control according to the first embodiment. The remote controller control processing unit 20 of the remote controller 10-1 and the portable terminal control processing unit 40 of the portable terminal 30 make the remote controller portable terminal communication unit 23 of the remote controller 10-1 and the portable terminal communication unit 42 of the portable terminal 30 communicable with each other (Step S01). The expression "communicable" refers to a state in which a connection process for communication has been completed and information can be transmitted and received. How to achieve such a communicable state is not limited in the present embodiment. For example, the communicable state is realized through infrared communication or Bluetooth (registered trademark). The portable terminal communication unit 42 and the remote controller portable terminal communication unit 23 can be made communicable with each other by an operation from either the remote controller control processing unit 20 or the portable terminal control processing unit 40.

The remote controller portable terminal communication unit 23 of the remote controller 10-1 generates transmission information on the basis of the first setting information stored in the remote controller storage unit 21 of the remote controller 10-1, and transmits the transmission information to the portable terminal communication unit 42 of the portable terminal 30 (Step S02). The transmission information includes the first setting information.

The portable terminal control processing unit 40 stores the first setting information included in the transmission information received by the portable terminal communication unit 42 in the portable terminal storage unit 41 (Step S03).

The portable terminal control processing unit 40 disconnects the communication between the remote controller 10-1 and the portable terminal 30, and makes the remote controller portable terminal communication unit 23 of the remote controller 10-2 and the portable terminal communication unit 42 of the portable terminal 30 communicable with each other (Step S04).

The portable terminal communication unit 42 transmits transmission information including the first setting information stored in the portable terminal storage unit 41 to the remote controller portable terminal communication unit 23 of the remote controller 10-2 (Step S05).

The remote controller control processing unit 20 of the remote controller 10-2 stores the first setting information included in the transmission information received by the remote controller portable terminal communication unit 23 in the remote controller storage unit 21, that is, sets the first setting information in the remote controller 10-2 (Step S06).

Even in a case where the model of the remote controller 10-1 and the model of the remote controller 10-2 are different from each other, the portable terminal 30 can set the remote controller 10-2 to have the same content of settings as the remote controller 10-1. In the case where the remote controller 10-2 does not have a function the remote controller 10-1 has, the portable terminal 30 causes the portable terminal display operation unit 31 to display that the remote controller 10-2 does not have that function. Similarly, also in a case where the model of the first air conditioner 50-1 and the model of the second air conditioner 50-2 are different from each other, when the second air conditioner 50-2 does not have a function the first air conditioner 50-1 has, the remote controller 10-2 displays that the second air conditioner 50-2 does not have that function on the remote controller display unit 11 of the remote controller 10-2.

As described above, in the present embodiment, the remote controller 10 includes the remote controller display unit 11, the remote controller operation unit 12, the indicator 13, the remote controller control processing unit 20, the remote controller storage unit 21, the remote controller indoor unit communication unit 22, and the remote controller portable terminal communication unit 23. The portable terminal 30 includes the portable terminal display operation unit 31, the portable terminal control processing unit 40, the portable terminal storage unit 41, and the portable terminal communication unit 42.

When setting similar first setting information in the first air conditioner 50-1 and the second air conditioner 50-2, the portable terminal 30 receives the first setting information from the first air conditioner 50-1 and transmits the first setting information to the second air conditioner 50-2. As a result, the user can minimize time required for performing settings as compared to repeating the settings of the first setting information every remote controller.

Second Embodiment

Next, an air conditioning system of a second embodiment will be described. A configuration of the air conditioning system of the present embodiment is similar to that of the air conditioning system 60 of the first embodiment. A constituent element having the same function as that in the first embodiment is denoted by the same reference sign as that in the first embodiment to omit redundant description.

Figure 11:
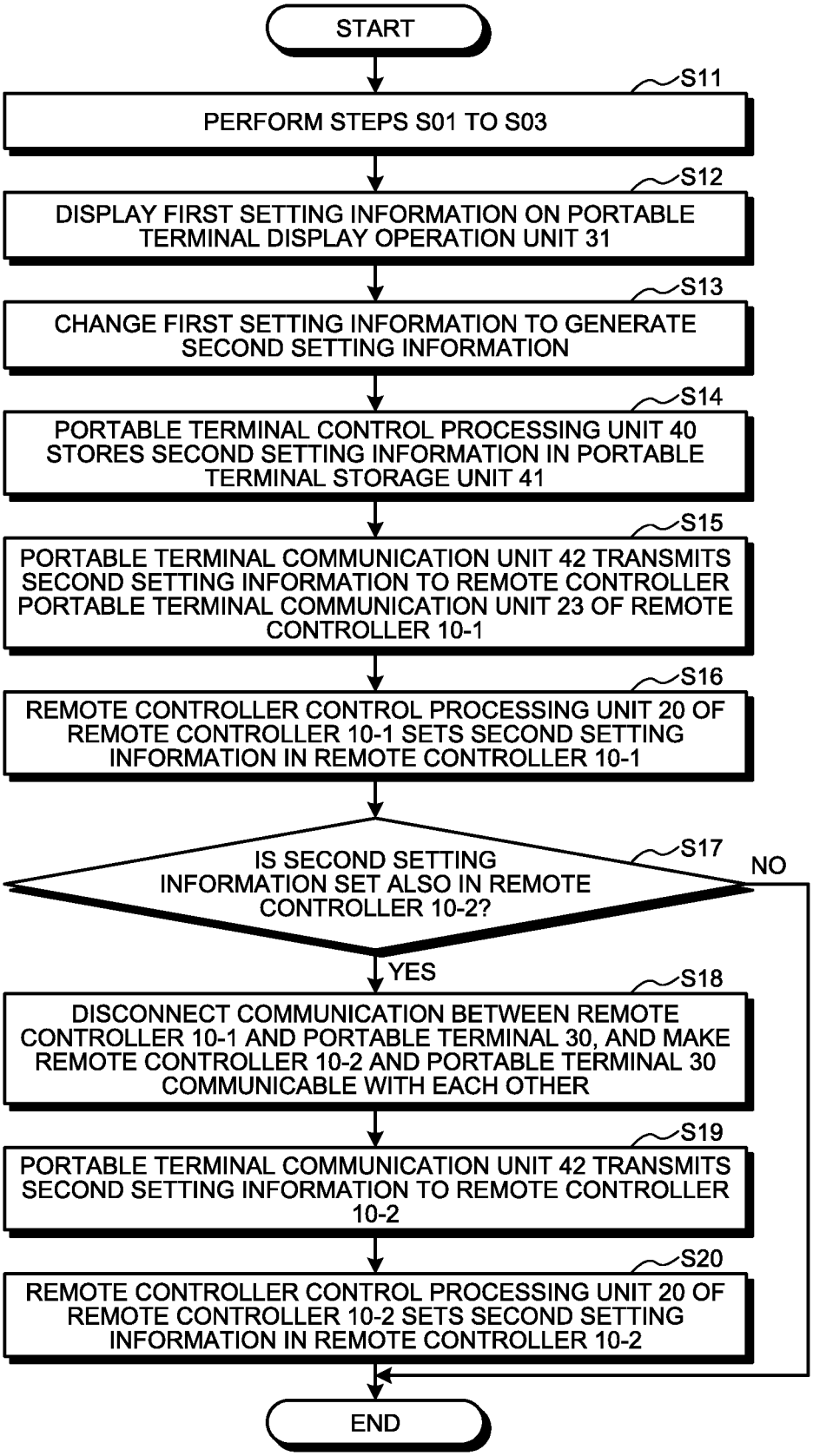
FIG. 11 is a flowchart illustrating a setting method for air conditioning control according to a second embodiment.

FIG. 11 is a flowchart illustrating a setting method for air conditioning control according to the second embodiment. The portable terminal control processing unit 40 performs Steps S01 to S03 illustrated in the flowchart of FIG. 10, makes the remote controller 10-1 and the portable terminal 30 communicable with each other, and stores the first setting information in the portable terminal storage unit 41. (Step S11).

The portable terminal control processing unit 40 causes the portable terminal display operation unit 31 to display the first setting information included in the transmission information received by the portable terminal communication unit 42 (Step S12).

The portable terminal display operation unit 31 receives the content of change to the first setting information from a user. The portable terminal control processing unit 40 generates second setting information by changing the first setting information on the basis of the content of change received by the portable terminal display operation unit 31 (Step S13).

The portable terminal control processing unit 40 stores the second setting information in the portable terminal storage unit 41 (Step S14).

The portable terminal communication unit 42 transmits transmission information including the second setting information stored in the portable terminal storage unit 41 to the remote controller portable terminal communication unit 23 of the remote controller 10-1 (Step S15).

The remote controller control processing unit 20 of the remote controller 10-1 stores the second setting information included in the transmission information received by the remote controller portable terminal communication unit 23 in the remote controller storage unit 21, that is, sets the second setting information in the remote controller 10-1 (Step S16).

When setting the second setting information also in the remote controller 10-2 (Step S17, Yes), the portable terminal control processing unit 40 disconnects the communication between the remote controller 10-1 and the portable terminal 30, and makes the remote controller portable terminal communication unit 23 of the remote controller 10-2 and the portable terminal communication unit 42 of the portable terminal 30 communicable with each other (Step S18). When it is determined as No in Step S17, the portable terminal control processing unit 40 ends the process.

The portable terminal communication unit 42 transmits transmission information including the second setting information stored in the portable terminal storage unit 41 to the remote controller portable terminal communication unit 23 of the remote controller 10-2 (Step S19).

The remote controller control processing unit 20 of the remote controller 10-2 stores the second setting information included in the transmission information received by the remote controller portable terminal communication unit 23 in the remote controller storage unit 21, that is, sets the second setting information in the remote controller 10-2 (Step S20).

As described above, in the present embodiment, the first setting information of the remote controller 10-1 of the first air conditioner 50-1 can be changed by the portable terminal 30. Consequently, by transmitting the changed first setting information to the remote controller 10-1 or the remote controller 10-2, the user can minimize time required for performing settings as compared to repeating the settings of the first setting information every remote controller.

Third Embodiment

Next, an air conditioning system of a third embodiment will be described. A configuration of the air conditioning system of the present embodiment is similar to that of the air conditioning system 60 of the first embodiment. A constituent element having the same function as that in the first embodiment is denoted by the same reference sign as that in the first embodiment to omit redundant description.

Figure 12:
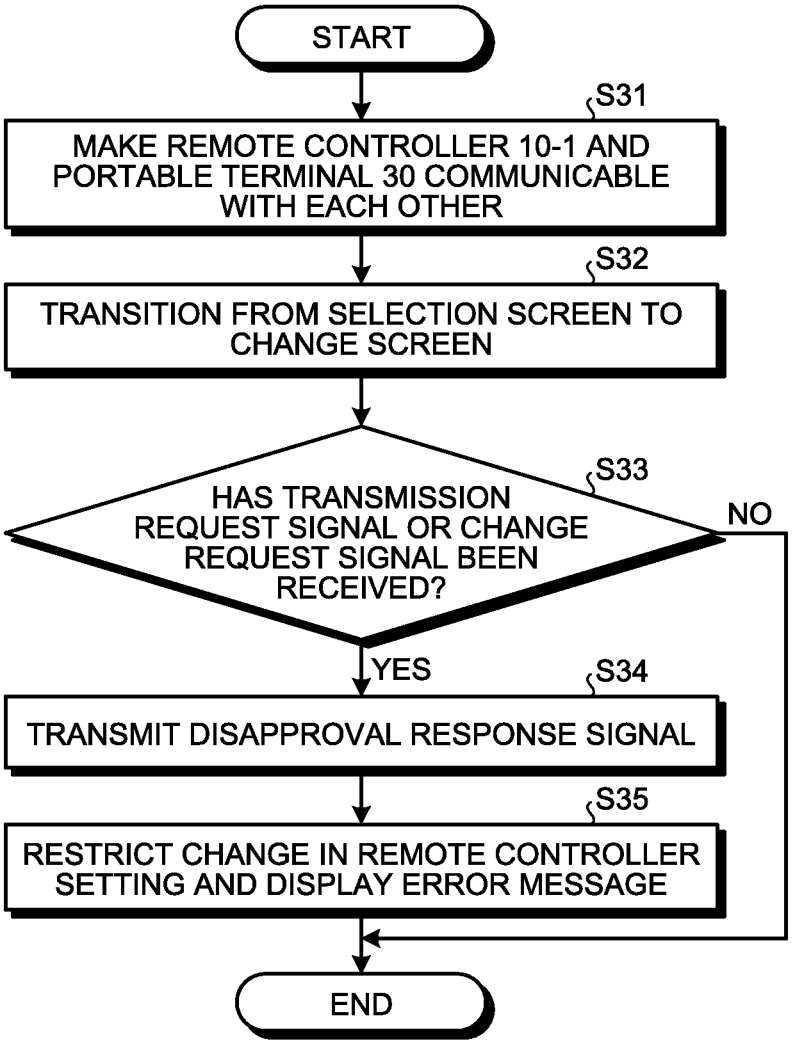
FIG. 12 is a flowchart illustrating an operation of an air conditioner according to a third embodiment.

In the present embodiment, when a first setting information piece in the remote controller 10 and a first setting information piece in the portable terminal 30 are changed by their respective different users, a possible conflict between the changed pieces is prevented. FIG. 12 is a flowchart illustrating an operation of an air conditioner according to the third embodiment.

The portable terminal control processing unit 40 or the remote controller control processing unit 20 performs Steps S01 to S03 illustrated in the flowchart of FIG. 10, and makes the remote controller 10-1 and the portable terminal 30 communicable with each other (Step S31).

When the first setting information of the remote controller 10-1 is changed, a screen displayed on the remote controller display unit 11 of the remote controller 10-1 transitions from the selection screen to the change screen (Step S32).

When the remote controller 10-1 receives a transmission request signal or a change request signal from the portable terminal 30 while the remote controller display unit 11 is displaying the change screen (Step S33, Yes), the remote controller control processing unit 20 of the remote controller 10-1 transmits a disapproval response signal to the portable terminal 30 (Step S34).

When the remote controller 10-1 does not receive the transmission request signal of the first setting information or the change request signal of the first setting information from the portable terminal 30 while the remote controller display unit 11 is displaying the change screen (Step S33, No), the process ends.

The transmission request signal is a signal for requesting transmission of the first setting information retained by the remote controller 10-1. The change request signal is a signal for requesting to change the first setting information changed by the portable terminal 30 to the first setting information of the remote controller 10-1. The disapproval response signal is a signal with which the remote controller 10-1 responds, to the portable terminal 30 which has transmitted the transmission request signal or the change request signal, that reception of the first setting information is disapproved or that changing the first setting information is disapproved. The case where the remote controller display unit 11 is displaying the change screen is described in the present embodiment, but when the setting screen of the first setting information displayed on the remote controller display unit 11 is configured to have three or more layers, the remote controller control processing unit 20 may transmit a disapproval response signal while the remote controller display unit 11 is displaying a screen other than the change screen.

The portable terminal control processing unit 40 of the portable terminal 30 that has received the disapproval response signal restricts changing the first setting information using the portable terminal display operation unit 31. The portable terminal control processing unit 40 of the portable terminal 30 causes the portable terminal display operation unit 31 to display an error message that reception of the first setting information is disapproved or that change in the first setting information is disapproved (Step S35).

In the present embodiment, even in a situation where the user of the portable terminal 30 cannot know by the remote controller 10-1 that the first setting information has been changed, it is displayed on the portable terminal display operation unit 31 of the portable terminal 30 that the first setting information has been changed by the remote controller 10-1. In addition, the portable terminal 30 restricts change in the first setting information of the remote controller 10-1. Consequently, the user of the portable terminal 30 knows that the first setting information has been changed also in the remote controller 10-1, and the restriction of the operation of the portable terminal 30 makes it possible to prevent the conflict between the first setting information changed by the remote controller 10-1 and the first setting information of the remote controller 10-1 changed by the portable terminal 30.

Fourth Embodiment

Figure 13:
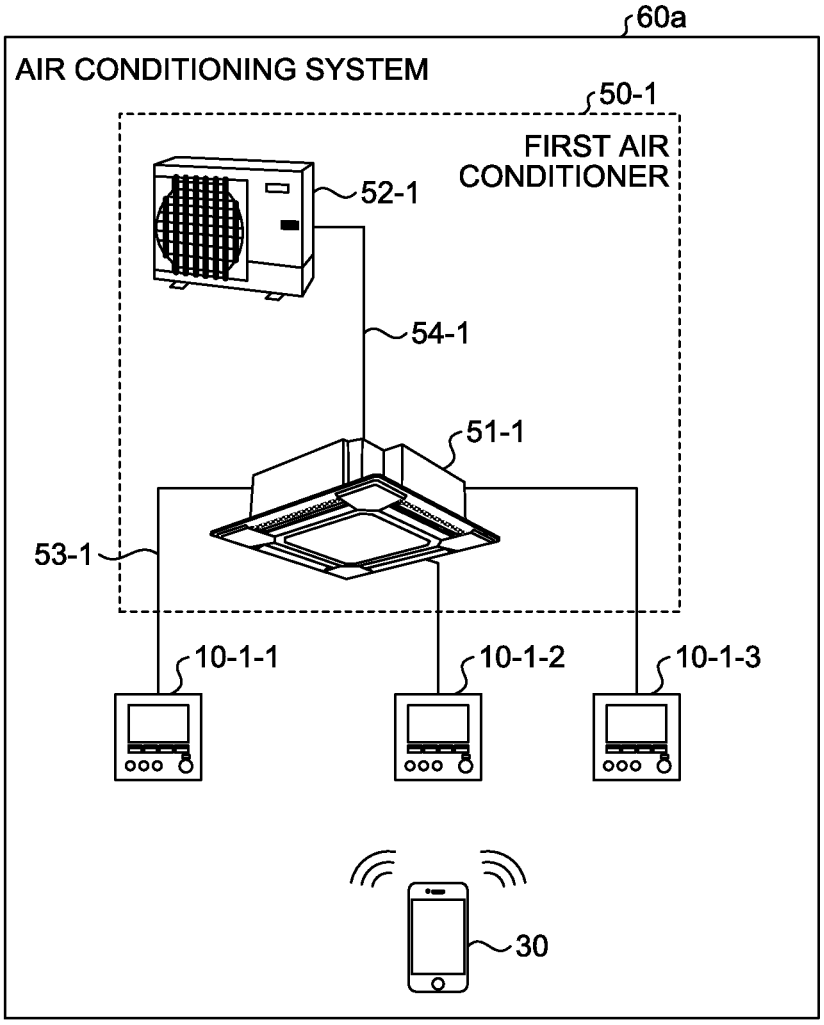
FIG. 13 is a system configuration diagram of an air conditioner according to a fourth embodiment.

Next, an air conditioning system of a fourth embodiment will be described. FIG. 13 is a system configuration diagram of an air conditioner according to the fourth embodiment. A configuration of an air conditioning system 60*a* of the present embodiment is different from that of the air conditioning system 60 of the first embodiment in that the number of remote controllers 10 is increased by two. In the present embodiment, the second air conditioner 50-2 and the remote controller 10-2 will not be described.

In the present embodiment, remote controllers that operate the first air conditioner 50-1 are a remote controller 10-1-1, a remote controller 10-1-2, and a remote controller 10-1-3. In the present embodiment, when the remote controller 10-1-1, the remote controller 10-1-2, and the remote controller 10-1-3 are mentioned without distinction, they are referred to as a remote controller 10 case by case. A constituent element having the same function as that in the first embodiment is denoted by the same reference sign as that in the first embodiment to omit redundant description. In the present embodiment, when the remote controller 10-1-1, the remote controller 10-1-2, and the remote controller 10-1-3 are installed in a range where they can communicate with the portable terminal 30, a user specifies the remote controller 10 connected to the portable terminal 30. In the present embodiment, an operation when the portable terminal 30 is connected to the remote controller 10-1-1 will be described.

Figure 14:
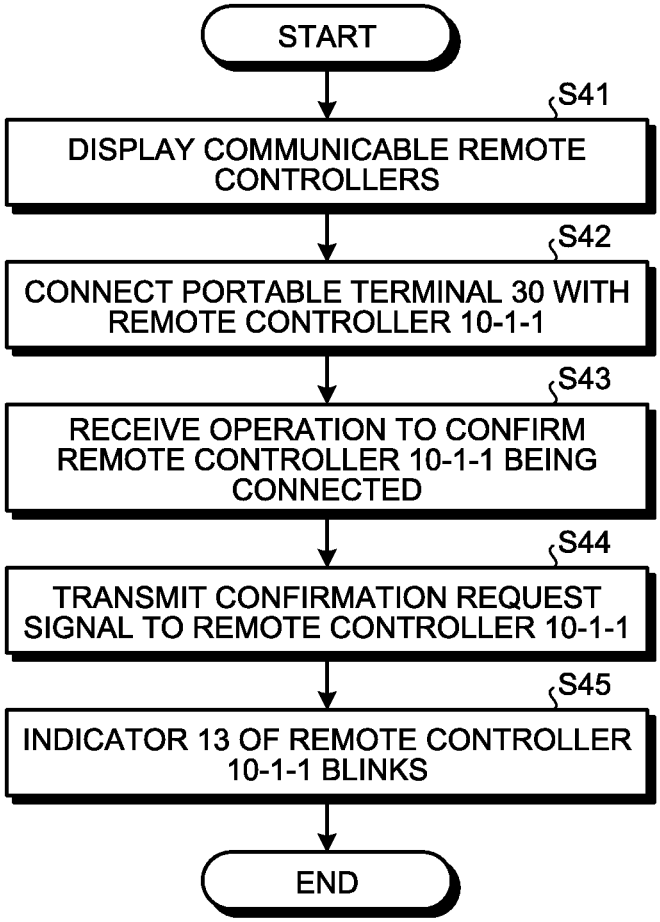
FIG. 14 is a flowchart illustrating an operation of the air conditioner according to the fourth embodiment.

FIG. 14 is a flowchart illustrating an operation of an air conditioner according to the fourth embodiment. The portable terminal display operation unit 31 displays the remote controller 10-1-1, the remote controller 10-1-2, and the remote controller 10-1-3 communicable with the portable terminal 30 (Step S41).

The portable terminal display operation unit 31 receives an operation to select the remote controller 10-1-1 to be connected to the portable terminal 30 from the start screen of the first setting information changing application, and the portable terminal control processing unit 40 connects the portable terminal 30 with the remote controller 10-1-1 (Step S42).

When the user presses the remote controller confirmation button 70 displayed on the setting screen of the first setting information changing application, the portable terminal display operation unit 31 receives an operation to confirm the remote controller 10-1-1 to which the portable terminal 30 is connected (Step S43).

The portable terminal control processing unit 40 causes the portable terminal communication unit 42 to transmit, to the remote controller 10-1-1, a confirmation request signal for confirming the remote controller 10-1-1 to which the portable terminal 30 is connected (Step S44).

The indicator 13 of the remote controller 10-1-1 connected to the portable terminal 30 blinks (Step S45).

When multiple remote controllers 10 are installed with respect to the first air conditioner 50-1, multiple remote controllers 10 may be present in a communicable range of the portable terminal 30. In addition, the name of the remote controller 10 may not be set inside the remote controller 10. According to the present embodiment, the user presses the remote controller confirmation button 70, thereby transmitting a confirmation request signal to the remote controller 10 from the portable terminal 30, and the user visually confirms blinking of the indicator 13 of the remote controller 10 that has received the confirmation request signal, and thereby the user can specify the remote controller 10 connected to the portable terminal 30.

The configuration described in each embodiment above indicates one example of the content of the present invention, and can be combined with other publicly known techniques and partially omitted and/or modified without departing from the scope of the present invention.

The invention claimed is:

1. An air conditioning system comprising:

a first air conditioner;

a second air conditioner;

a first operation terminal capable of operating the first air conditioner;

a second operation terminal capable of operating the second air conditioner; and a portable terminal to receive, from the first operation terminal, first setting information formed from first information for operating the first air conditioner or the second air conditioner and second information that is information on the first operation terminal or the second operation terminal, to generate transmission information on the basis of the first setting information, and to transmit the transmission information to the second operation terminal, wherein the first operation terminal and the second operation terminal each comprise a remote controller display unit to display the first setting information, wherein the portable terminal is configured to transmit one of a transmission request signal or a change request signal to at least one of the first operational terminal and the second operational terminal, the transmission request signal being a signal requesting transmission of the first setting information, and the change request signal being a signal requesting a change in the first setting information, and wherein the first operation terminal and the second operation terminal are each configured to transmit a disapproval response signal to the portable terminal that either disapproves reception of the first setting information in response to a determination that the transmission request signal is received when the first setting information is displayed on a corresponding one of the remote control display units or disapproves change of the first setting information in response to a determination that the change request signal is received when the first setting information is displayed on the corresponding one of the remote control display units.

2. The air conditioning system according to claim 1, wherein the transmission information includes the first setting information.

3. The air conditioning system according to claim 2, wherein the first information and the second information include:

information on a model name and a serial number of an indoor unit to which the first operation terminal is connected;

information on a model name and a serial number of an outdoor unit to which the first operation terminal is connected;

information on a model name and a serial number of an indoor unit to which the second operation terminal is connected; and information on a model name and a serial number of an outdoor unit to which the second operation terminal is connected.

4. The air conditioning system according to claim 1, wherein the transmission information includes second setting information generated on the basis of the first setting information.

5. The air conditioning system according to claim 4, wherein the portable terminal retains a plurality of pieces of the first setting information and the second setting information of the first air conditioner; and a plurality of pieces of the first setting information and the second setting information of the second air conditioner.

6. The air conditioning system according to claim 5, wherein the first information and the second information include:

information on a model name and a serial number of an indoor unit to which the first operation terminal is connected;

information on a model name and a serial number of an outdoor unit to which the first operation terminal is connected;

information on a model name and a serial number of an indoor unit to which the second operation terminal is connected; and information on a model name and a serial number of an outdoor unit to which the second operation terminal is connected.

7. The air conditioning system according to claim 4, wherein the first information and the second information include:

information on a model name and a serial number of an indoor unit to which the first operation terminal is connected;

information on a model name and a serial number of an outdoor unit to which the first operation terminal is connected;

information on a model name and a serial number of an indoor unit to which the second operation terminal is connected; and information on a model name and a serial number of an outdoor unit to which the second operation terminal is connected.

8. The air conditioning system according to claim 1, wherein the portable terminal comprises a portable terminal display operation unit to display the first setting information and to receive change in the first setting information, and when receiving the disapproval response signal, the portable terminal performs at least one of restriction of the change in the first setting information using the portable terminal display operation unit, and display of a state to the effect that reception of the first setting information is disapproved or that change in the first setting information is disapproved on the portable terminal display operation unit.

9. The air conditioning system according to claim 8, wherein the first information and the second information include:

information on a model name and a serial number of an indoor unit to which the first operation terminal is connected;

information on a model name and a serial number of an outdoor unit to which the first operation terminal is connected;

information on a model name and a serial number of an indoor unit to which the second operation terminal is connected; and information on a model name and a serial number of an outdoor unit to which the second operation terminal is connected.

10. The air conditioning system according to claim 1, wherein the first information and the second information include:

information on a model name and a serial number of an indoor unit to which the first operation terminal is connected;

information on a model name and a serial number of an outdoor unit to which the first operation terminal is connected;

information on a model name and a serial number of an indoor unit to which the second operation terminal is connected; and information on a model name and a serial number of an outdoor unit to which the second operation terminal is connected.

11. The air conditioning system according to claim 1, wherein the first operation terminal and the second operation terminal each comprise an indicator to blink in response to a request from the portable terminal the portable terminal is configured to send a confirmation request signal to a selected operation terminal selected from the first operation terminal and the second operation terminal to confirm that the selected operation terminal is connected to the portable terminal, and the selected operation terminal is further configured to cause the indicator associated with the selected operation terminal to blink after the selected operation terminal is connected to the portable terminal the selected operation terminal receives the confirmation request signal from the portable terminal.

* * * * *